US006312532B1

(12) United States Patent
Kangas

(10) Patent No.: US 6,312,532 B1
(45) Date of Patent: Nov. 6, 2001

(54) FERRITIC-AUSTENITIC STEEL ALLOY

(75) Inventor: Pasi Kangas, Sandviken (SE)

(73) Assignee: Sandvik AB, Sandviken (SE)

( * ) Notice: Subject to any disclaimer, the term of this patent is extended or adjusted under 35 U.S.C. 154(b) by 0 days.

(21) Appl. No.: 09/605,981

(22) Filed: Jun. 29, 2000

(30) Foreign Application Priority Data

Jun. 29, 1999 (SE) ..... 9902472

(51) Int. Cl.[7] ..... C22C 38/42; C22C 38/44
(52) U.S. Cl. ..... 148/325; 148/327
(58) Field of Search ..... 148/325, 327

(56) References Cited

U.S. PATENT DOCUMENTS 5,284,530 2/1994 Azuma et al. .
5,298,093 3/1994 Okamoto .
5,582,656 12/1996 Kangas et al. .
5,733,387 3/1998 Lee et al. .

FOREIGN PATENT DOCUMENTS 501321 1/1995 (SE) .
96/39543 12/1996 (WO) .

*Primary Examiner*—Deborah Yee
(74) *Attorney, Agent, or Firm*—Burns, Doane, Swecker & Mathis, L.L.P.

(57) ABSTRACT

A duplex stainless steel alloy has been developed, which contains in weight-%:

C maximum 0.05
Si maximum 0.8
Mn 0.3–4
Cr 27–35
Ni 3–10
Mo 0–3
N 0.30–0.55
Cu 0.5–3.0
W 2.0–5.0
S maximum 0.010 balance Fe and normally occurring impurities and additions. The content of Fe is 30–70 volume-%. The steel alloy well suited in those chloride environments, where demands are made on good resistance to crevice corrosion. A relatively high content of W has at the same time given a good effect on both the pitting- and crevice corrosion properties.

14 Claims, 6 Drawing Sheets

Influence of Cu, Mo and W on the structural stability, measured as quantity of sigma-phase in the structure at a cooling rate of 17.5°C/min. from annealing temperature

FERRITIC-AUSTENITIC STEEL ALLOY

FIELD OF THE INVENTION

The present invention relates to a ferritic-austenitic stainless steel with high contents of Cr, N, Cu and W in combination with relatively low contents of Ni and Mo. The material is suitable for applications where high resistance to corrosion is desire, especially in acidic or basic environments, where you have high chloride contents at the same time.

BACKGROUND OF THE INVENTION

The following discussion of the state of the art should not be construed as an admission of prior art.

Duplex steel is characterized by a ferritic-austenitic structure, where both phases have different compositions. Modern duplex steel will mainly be alloyed with Cr, Mo, Ni and N. The duplex steel grade SAF 2507 (UNS S32750) has high contents of Cr, Mo and N for a high resistance to pitting corrosion. This resistance is often described as a PRE-number (PRE =Pitting Resistance Equivalent=%Cr+3.3% Mo+16N). The alloy is consequently optimized with respect to this property and has a good resistance in many acids and bases, but the alloy is above all developed for resistance in chloride environments. The elements Cu and W have been used as alloying additions. Consequently has for example the steel grade DP3W (UNS S39274) which has an analogous composition as SAF 2507, but it is alloyed with 2.0% W as substitute for a share of the Mo-content in the alloy. The steel grade Uranus 52N+(NS S32529) has similarly an analogous composition as SAF 2507, but it is alloyed with 1.5% Cu with the purpose to improve the resistance in acid environments. The steel grade Zeron 100 is a further steel grade which is analogous to SAF 2507, but this is alloyed with both about 0.7% Cu and 0.7% W. The steel grade DTS 25.7NWCu (UNS S39277) is in this composition very similar to SAF 2507, besides that it is alloyed with about 1.7% Cu and 1.0% W. In relation with that it is alloyed with W, a PRE formula was produced, which also includes the element W with a weight corresponding the halve of this for Mo., i.e.—PRENW=%Cr+3.3(%Mo+0.5% W)+16N. All described steel grades have a PRE number, irrespective to the calculation method, that is over 40.

Another type of ferritic-austenitic alloy with high resistance to chloride is the steel grade described in the Swedish Patent 9302139-2 or U.S. Pat. No. 5,582,656. This type of alloy is characterized by Mn 0.3–4%, Cr 28–35%, Ni 3–10%, Mo 1–3%, Cu maximum 1.0% and W maximum 2.0%, and has a high PRE number, generally over 40. The biggest difference compared with the established superduplex steel SAF 2507 and others is that the contents of Cr and N are higher in this steel grade. This steel grade has been used in environments where the resistance to intergranular corrosion and corrosion in ammonium carbamates is of importance, but the alloy also has a very high resistance to chloride environments.

SUMMARY OF THE INVENTION

One purpose of the present invention is to provide a material with high resistance to chloride environments, at the same time the material has extraordinary properties in acidic and basic environments combined with good mechanical properties and high structural stability. This combination can be very useful in applications within for example the chemical industry, where you have problems with corrosion caused by acids and at the same time have a contamination of the acid with chlorides, which further amplifies the corrosive effect. These properties of the alloy in combination with a high strength lead to advantageous design solutions from an economic point of view. There are certainly existing materials with very good properties in acid environments, but these are often steels with high contents of Ni, which makes the costs of such materials excessively high. Another disadvantage with austenitic steel compared with duplex alloys is that the strength in the austenitic steel is usually considerably lower.

In the present day situation there are no duplex stainless steels described that are optimized for this combination of properties, and which then attain those good properties which are described here.

According to one preferred aspect, the present invention provides a ferrite-austenite steel alloy having good warm workability, high resistance to crevice corrosion and good structural stability, comprising in weight-%:

C maximum 0.05%;

Si maximum 0.8%;

Mn 0.30–4.0%;

Cr 27.0–35.0%;

Ni 3.0–10.0%;

Mo 0–3.0%;

N 0.30–0.55%;

Cu 0.5–3.0%;

W 2.0–5.0%;

S maximum 0.010%; and balance Fe and normally occurring steelmaking additions for deoxidization and hot ductility;

wherein the alloy comprises 30–70 volume % ferrite and the balance austenite.

DETAILED DESCRIPTION

Figure 1:
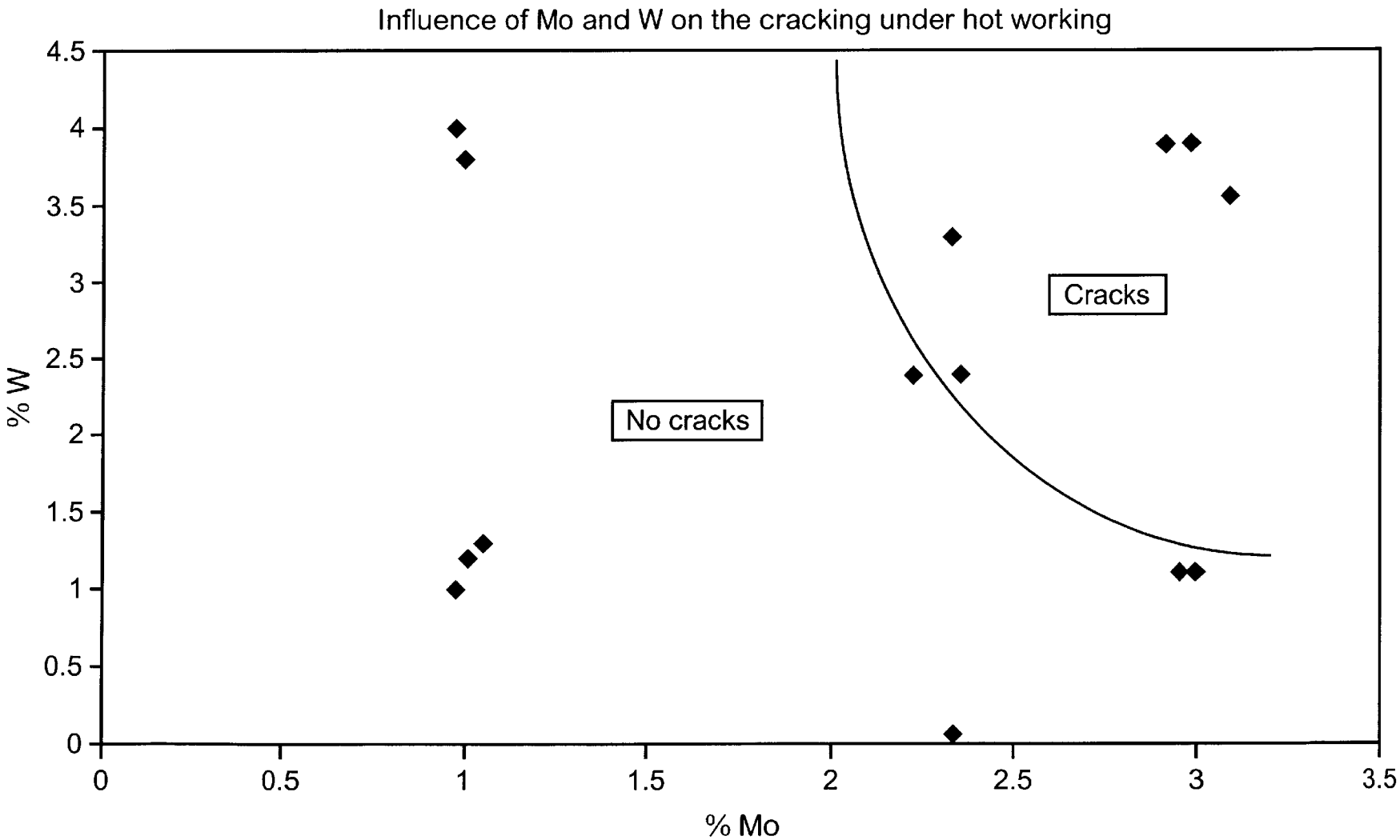
FIG. 1 is a plot of Mo vs. W content showing the influence of these components on cracking behavior.

By developing an alloy where high contents of Cr and Ni in combination with the elements Cu and W are used as alloying elements, surprisingly good corrosion properties and mechanical properties have been achieved by the present invention.

According to a preferred aspect, an alloy according to the present invention contains in weight-%:

C maximum 0.05;

Si maximum 0.8;

Mn 0.3–4;

Cr 27–35;

Ni 3–10;

Mo 0–3;

N 0.30–0.55;

Cu 0.5–3.0;

W 2.0–5.0; and

S maximum 0.010;

the balance being Fe and normally occurring impurities and additions. The ferrite content is 30–70 volume-%.

Carbon has to be seen as an impurity element in this invention and has a limited solubility in both ferrite and austenite. The limited solubility implies a risk for precipitation of carbonitrides and for that the C content should be limited to a maximum 0.05%, preferably to maximum 0.03% and most preferably to a maximum 0.02%.

Silicon is used as a deoxidant during steelmaking and also improves the floability under production and welding. However, high contents of Si favor the precipitation of an intermetallic phase, for this reason the content should be limited up to maximum 0.8%.

Manganese will be added in order to improve the solubility of N in the material. However, Mn has only a limited effect on the N-solubility in the present type of alloy. Instead there are other elements with higher effect on the N-solubility. Moreover, Mn can, in combination with the high sulfur-content, cause manganese sulfides which act as initiating points for pitting corrosion. Therefore, the content of Mn should be limited to between 0.3–4%.

Chromium is a very active element to improve the resistance to the majority of corrosion types. Besides, Cr improves the strength of the alloy. A high content of Cr implies furthermore that you attain a very good N-solubility in the material. Thus it is desirable to keep the Cr content as high as possible to improve the resistance to corrosion. In order to obtain a very good resistance to corrosion the content of Cr should be at least 27%. However, high contents of Cr increase the risk for intermetallic precipitations. Therefore the content of Cr should be limited to maximum 35%.

Nickel will be used an austenite stabilizing element and will be added on a suitable level so that the desired content of ferrite will be obtained. In order to obtain contents of ferrites between 30–70% an addition of3–10% Nickel is appropriate.

Molybdenum is a very active element to improve the corrosion resistance in chloride environments and also in reducing acids. However, a high content of Mo, in combination with a high content of Cr and W, causes an increasing risk for intermetallic precipitations. Thus, the Mo content in the present invention should be limited to maximum 3.0%.

Nitrogen is a very active element, which on one hand increases the corrosion resistance and on the other hand increases the structural stability and also the strength of the material. Furthermore, a high N-content improves the rebuilding of the austenite after welding, which gives good properties at welding joints. In order to obtain these effects of N, at least 0.30% N should be added. At high contents of N the risk for precipitation of chromium nitrides increases, especially if there is a high chromium-content. Furthermore, a high N-content implies that the risk for porosity increases because the solubility of N in the melt will be exceeded. For these reasons the N-content should be limited to maximum 0.55%.

Copper increases the general corrosion resistance in acid environments such as sulfuric acid. Surprisingly it has been shown that Cu in materials with relatively high contents of Mo and/or W slows down the rate of precipitation of intermetallic phase during slow cooling. In order to increase the structural stability of the material, the content of Cu should exceed 1%, and should preferably exceed 1.5%. Nevertheless, high contents of Cu imply that the solid solubility will be exceeded. By this reason the content of Cu should be limited to maximum 3%.

Tungsten increases the risk for pitting and crevice corrosion. Surprisingly, it has been shown that the addition of W as a substitute for Mo increases the low temperature impact strength. In order to obtain an adequate effect on the impact strength and also the corrosion properties, at least 2% W should be added. A simultaneous addition of W and Cu, where W substitutes the element Mo in the alloy with the purpose to improve the pitting corrosion properties, can furthermore be done with the purpose to increase the resistance to intergranular corrosion. However, high contents of W in combination with high contents of Cr and Mo increase the risk for intergranular precipitations. The content of W should therefore be limited to maximum 5%.

Sulfur negatively influences the corrosion resistance by forming easily soluble sulfides. Furthermore the hot workability deteriorates. Therefore, the content of S should be limited to maximum 0.010%.

The content of ferrites is important to obtain good mechanical properties, corrosion properties and also good weldability. From the corrosion and weldability point of view it is desirable to have a ferrite content between 30–70%. High ferrite contents deteriorate that the low temperature impact strength and the resistance to hydrogen embrittleness. Therefore, the ferrite content is 30–70%, preferably 35–55%.

EXAMPLES

In the examples below the composition of some experimental heats is shown. The examples illustrate the influence of different alloying elements on the properties.

A number of experimental heats were produced by casting of 170 kg ingot, which was hot forged to round bars. Those were extruded to bars, from where the test material was taken. Table 1 shows the composition of experimental heats with a calculated PRENW-number with the formula PRENW=%Cr+3.3(%Mo+0.5% W)+16% N.

TABLE 1

Composition of experimental heats, weight-%

| Steel | Heat | C | Si | Mn | Cr | Ni | Mo | Cu | W | N | PRENW |
|---|---|---|---|---|---|---|---|---|---|---|---|
| 1 | 654792 | 0.020 | 0.33 | 1.05 | 30.0 | 8.3 | 3.08 | 1.99 | 3.56 | 0.39 | 52.3 |
| 2 | 654795 | 0.023 | 0.19 | 0.91 | 29.9 | 7.8 | 2.9 | 1.8 | 3.9 | 0.40 | 52.3 |
| 3 | 654796 | 0.011 | 0.16 | 0.96 | 30.2 | 6.5 | 1.0 | 0.55 | 1.2 | 0.40 | 42.0 |
| 4 | 605084 | 0.018 | 0.19 | 1.16 | 27.4 | 6.0 | 0.96 | 0.61 | 4.0 | 0.39 | 43.4 |
| 5 | 605085 | 0.014 | 0.15 | 1.03 | 27.6 | 5.33 | 2.96 | 2.0 | 1.1 | 0.37 | 45.2 |
| 6 | 605086 | 0.016 | 0.11 | 0.91 | 29.9 | 9.65 | 2.97 | 0.61 | 3.9 | 0.31 | 51.1 |
| 7 | 654793 | 0.015 | 0.28 | 0.95 | 30.1 | 7.4 | 1.04 | 1.98 | 1.29 | 0.30 | 40.5 |

TABLE 1-continued

| Steel | Heat | C | Si | Mn | Cr | Ni | Mo | Cu | W | N | PRENW |
|---|---|---|---|---|---|---|---|---|---|---|---|
| | | Composition of experimental heats, weight-% | | | | | | | | | |
| 8 | 605088 | 0.012 | 0.18 | 0.98 | 29.7 | 7.62 | 0.97 | 2.0 | 1.0 | 0.31 | 39.5 |
| 9 | 605089 | 0.013 | 0.14 | 0.95 | 27.5 | 7.18 | 0.98 | 2.0 | 3.8 | 0.31 | 42.0 |
| 10 | 605090 | 0.014 | 0.12 | 0.91 | 27.7 | 7.69 | 2.98 | 0.61 | 1.1 | 0.31 | 44.3 |
| 11 | 605091 | 0.014 | 0.12 | 0.87 | 28.7 | 7.58 | 2.32 | 0.09 | 2.4 | 0.36 | 46.1 |
| 12 | 605092 | 0.011 | 0.11 | 0.98 | 28.6 | 6.19 | 2.33 | 1.5 | 0.05 | 0.39 | 42.5 |
| 13 | 605094 | 0.012 | 0.08 | 0.91 | 28.6 | 7.16 | 2.22 | 1.50 | 2.4 | 0.35 | 45.5 |
| 14 | 605095 | 0.014 | 0.07 | 0.87 | 28.6 | 7.44 | 2.32 | 1.54 | 3.3 | 0.36 | 47.5 |

Production

Material for all heats was produced by ingot casting, hot forging and extrusion. Some variations cracked under production because of high amounts of intermetallic phase. Table 2 illustrates how the production was running:

TABLE 2

Results of the production of heats

| Steel | Heat | Result |
|---|---|---|
| 1 | 654792 | Cracks under forging |
| 2 | 654795 | Cracks under forging |
| 3 | 654796 | O.k., a few cracks on the surface under forging |
| 4 | 605084 | O.k., no cracks |
| 5 | 605085 | O.k., no cracks |
| 6 | 605086 | Cracks under forging |
| 7 | 654793 | O.k., a few cracks on the surface under forging |
| 8 | 605088 | O.k., no cracks |
| 9 | 605089 | O.k., no cracks |
| 10 | 605090 | Cracks under forging |
| 11 | 605091 | Cracks under forging |
| 12 | 605092 | O.k., no cracks |
| 13 | 605094 | Cracks under forging |
| 14 | 605095 | Cracks under forging |

There is a relation between the composition of the alloy and the tendency of cracking during forging. Consequently no heats with a PRENW-number at 45.5 or higher pass the forging without cracking. If the content of Mo is over 2% it is necessary that the content of W is maximum about 1% in order to avoid high quantities of intermetallic phase. On the other hand, if the content of W is high, it is necessary that the content of Mo is low in order to avoid intermetallic phase and the resulting cracking. This relationship is illustrated graphically in FIG. 1.

Structural Stability

The samples were annealed at 800–1200° C. in steps of 50° C. The temperature when the quantity of intermetallic phase became negligible, was determined in this connection with help of studies in a lightoptical microscope. The material was then annealed at this temperature with three minutes holding time, thereafter the samples were cooled at a rate of 140° C./min and 17.5° C./min to room temperature. The quantity of sigma-phase in this material was counted with help of counting the points under a light optical microscope. The results appear in Table 3.

TABLE 3

Quantity of sigma-phase after cooling with different rates from 1100° C. to room temperature.

| Heat | Annealing temperature ° C. | −17.5° C./min | −140° C./min |
|---|---|---|---|
| 654796 | 1100 | 10 | 0 |
| 605084 | 1050 | 5 | 0 |
| 605085 | 1100 | 1 | 0 |
| 654793 | 1100 | 0 | 0 |
| 605088 | 1050 | 1 | 0 |
| 605089 | 1100 | 0 | 0 |
| 605092 | 1100 | 5 | 0 |

Figure 2:
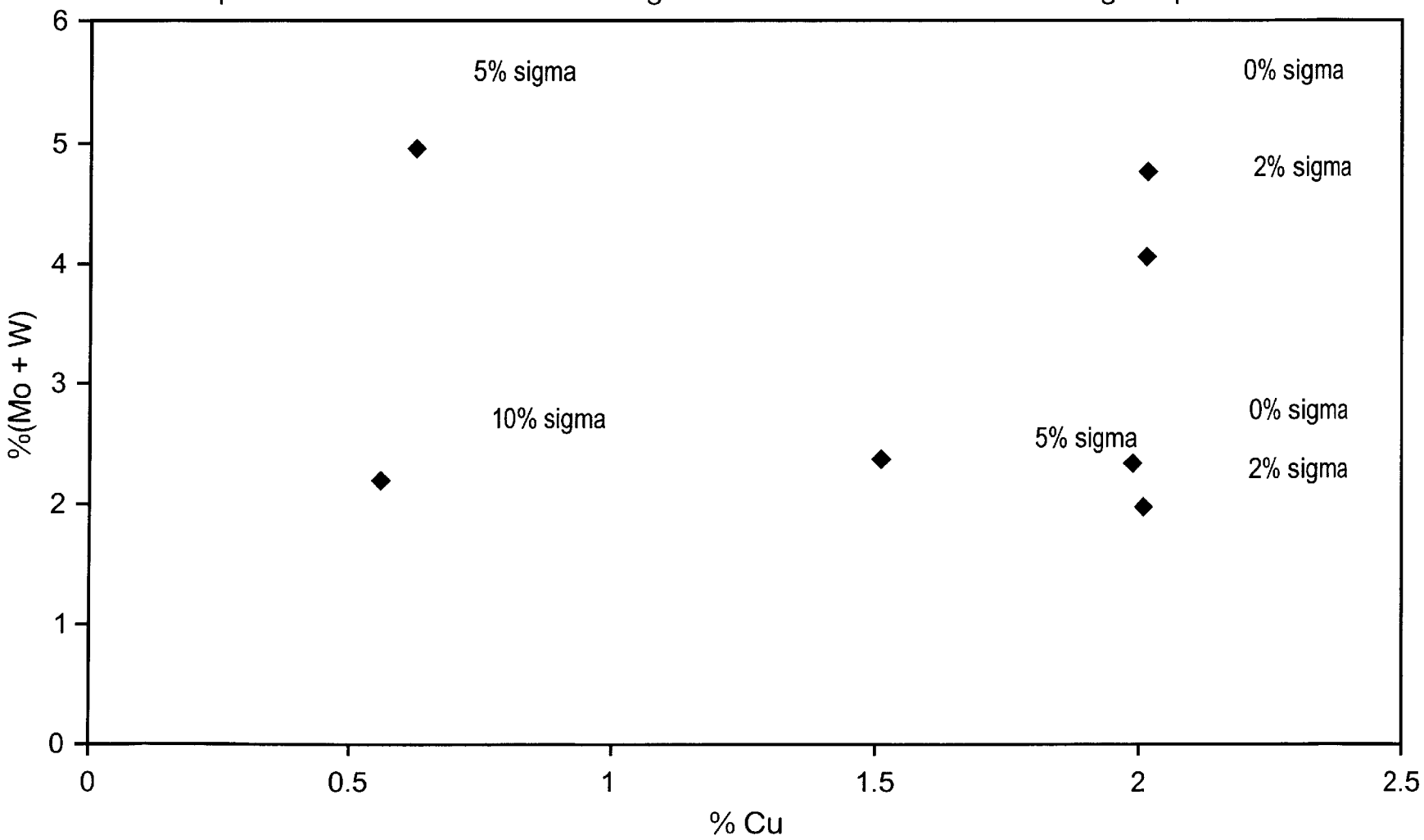
FIG. 2 is a plot of Cu vs. (Mo+W) content showing the influence of these components on structural stability.
Figure 3:
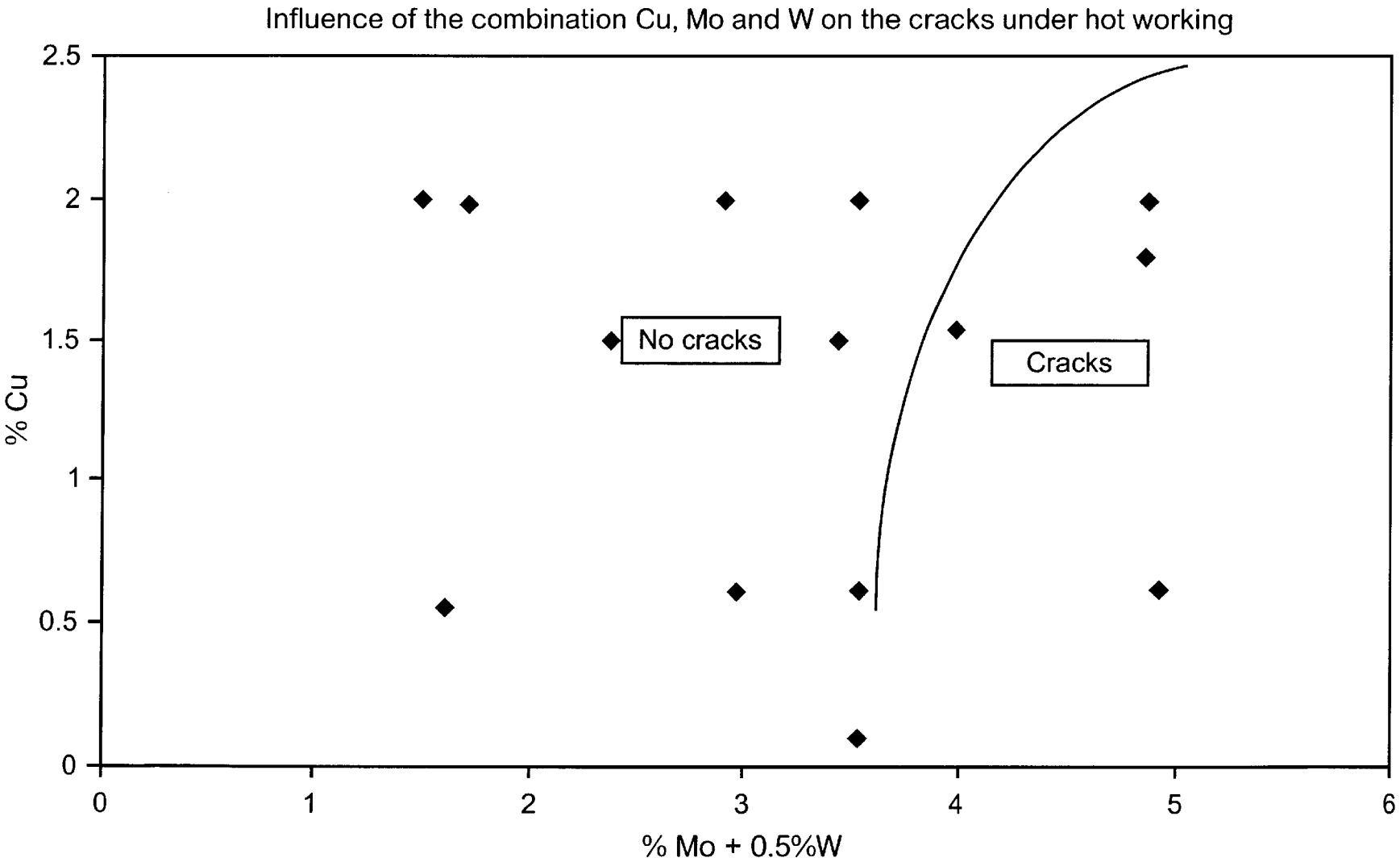
FIG. 3 is a plot of (Mo+W) vs. Cu content showing the influence of these components on cracking behavior.

It appears that material with high content of W has a very good structural stability, especially if the content of Mo is low (heat 605089). Unexpectedly it has shown that even material with high content of Cu and low content of N (heat 605089) under slow cooling (17.5° C./min) has a better structural stability than a material with a low content of Cu and a high content of N (heat605084). It is known that the addition of the element N increases the structural stability in duplex steels, while the effect of Cu is more uncertain. However, heat 654796 with both a low content of Mo and low Cu-content has inferior structural stability at slowly cooling (17.5° C./min) than heat 605085 with 2% Cu, in spite of the fact that heat 605085 has a content of Mo near 3%. The relation is illustrated graphically in FIG. 2. The relationship between Mo, W and Cu and the favorable effect of the addition of Cu are illustrated graphically in FIG. 3, where the influence of Cr, W and Cu on the cracks under hot working is shown. The cracking under hot working in this case is due mainly to the occurrence of an intermetallic phase.

Mechanical Properties

The strength and the impact strength were measured for some heats. The results appear in Table 4.

TABLE 4

Mechanical properties (tensile test at room temperature and impact strength at room temperature and at −50° C.)

| Heat | RP0.2 MPa | Rm MPa | A5 % | Z5 | Impact strength J +20° C. | Impact strength J −50° C. |
|---|---|---|---|---|---|---|
| 654796 | 688 | 880 | 38.2 | 69 | 212 | 97 |
| 605084 | 680 | 899 | 37.3 | 68 | 207 | 159 |
| 605085 | 725 | 920 | 35.4 | 66 | 157 | 50 |
| 654793 | 706 | 923 | 33.5 | 68 | 167 | 133 |
| 605088 | 647 | 884 | 36.9 | 70 | 201 | 180 |
| 605089 | 698 | 917 | 36.2 | 70 | 198 | 161 |
| 605092 | 648 | 873 | 39.9 | 70 | 217 | 183 |

For all materials a high yield point in tension was obtained and also the impact strength at 20° C. is high. For the impact strength at −50° C. it has surprisingly shown that the heat 605085 has lower impact strength than heat 605084. The reason for this can be either that the heat 605084 has a lower content of Cu or a higher content of W. Because heat 605089 has both a high Cu and high W content this shows a good impact strength at −50° C., it is probable that a high content of W is preferable to a high content of Mo if a high impact strength at low temperatures is requested.

Corrosion

Pitting and crevice corrosion properties were tested in $FeCl_3$ according to ASTM G48C and also MTI-2. A critical pitting corrosion temperature (CPT) and also crevice corrosion temperature (CCT) were hereby determined. The results of all experiments are shown in Table 5.

TABLE 5

Critical pitting/crevice corrosion temperature for the tested steel grades.

| Heat | CPT* ASTM G48C (° C.) | CCT* MTI-2 (° C.) |
|---|---|---|
| 654796 | 47 | 40 |
| 605084 | 72 | 64 |
| 605085 | 60 | 60 |
| 654793 | 57 | 47 |
| 605088 | 60 | 37 |
| 605089 | 70 | 47 |
| 605092 | 65 | 54 |

(* = The reported value is the average of two experiments.)

Figure 4:
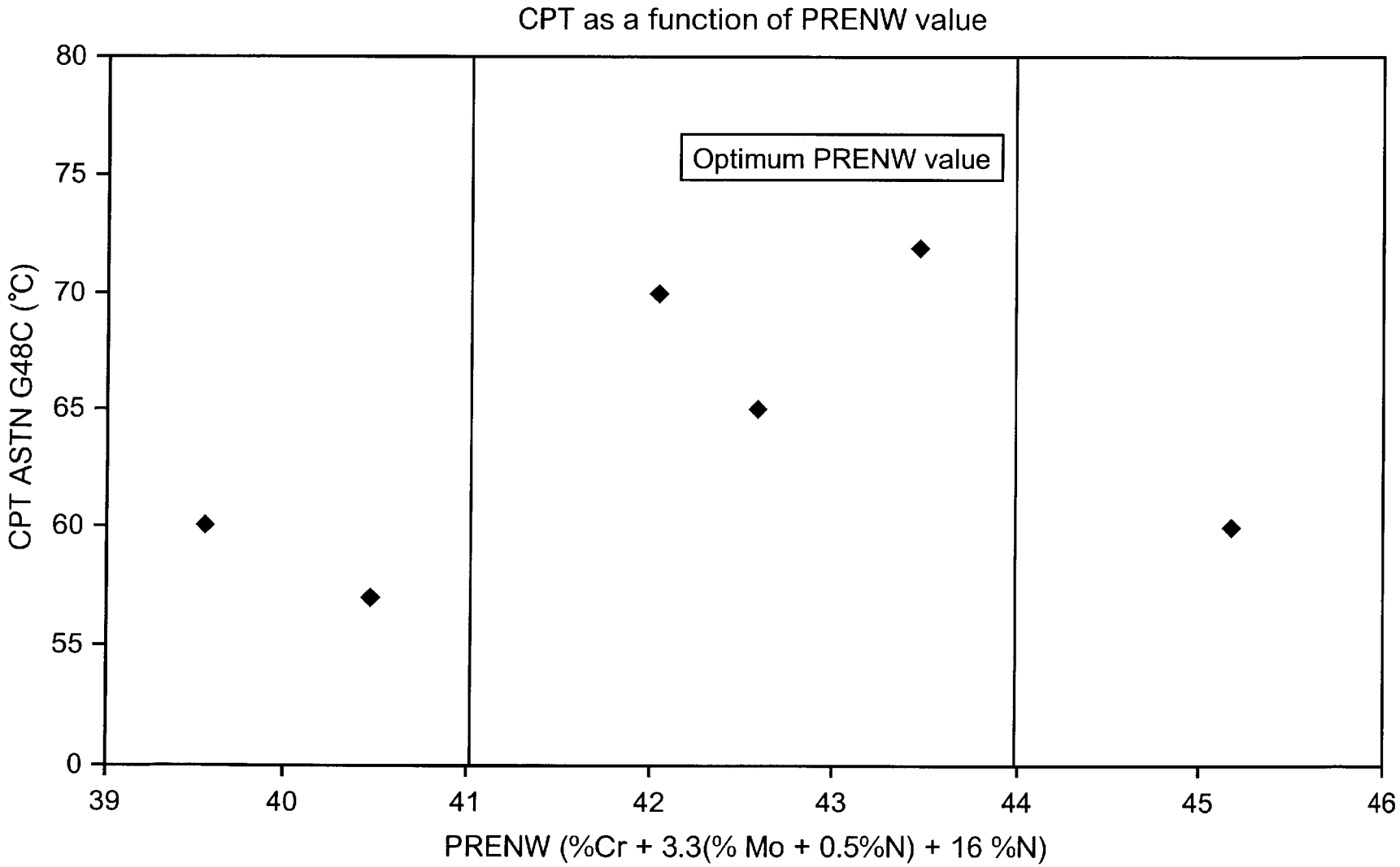
FIG. 4 is a plot of the PRENW value vs. the CPT value.
Figure 5:
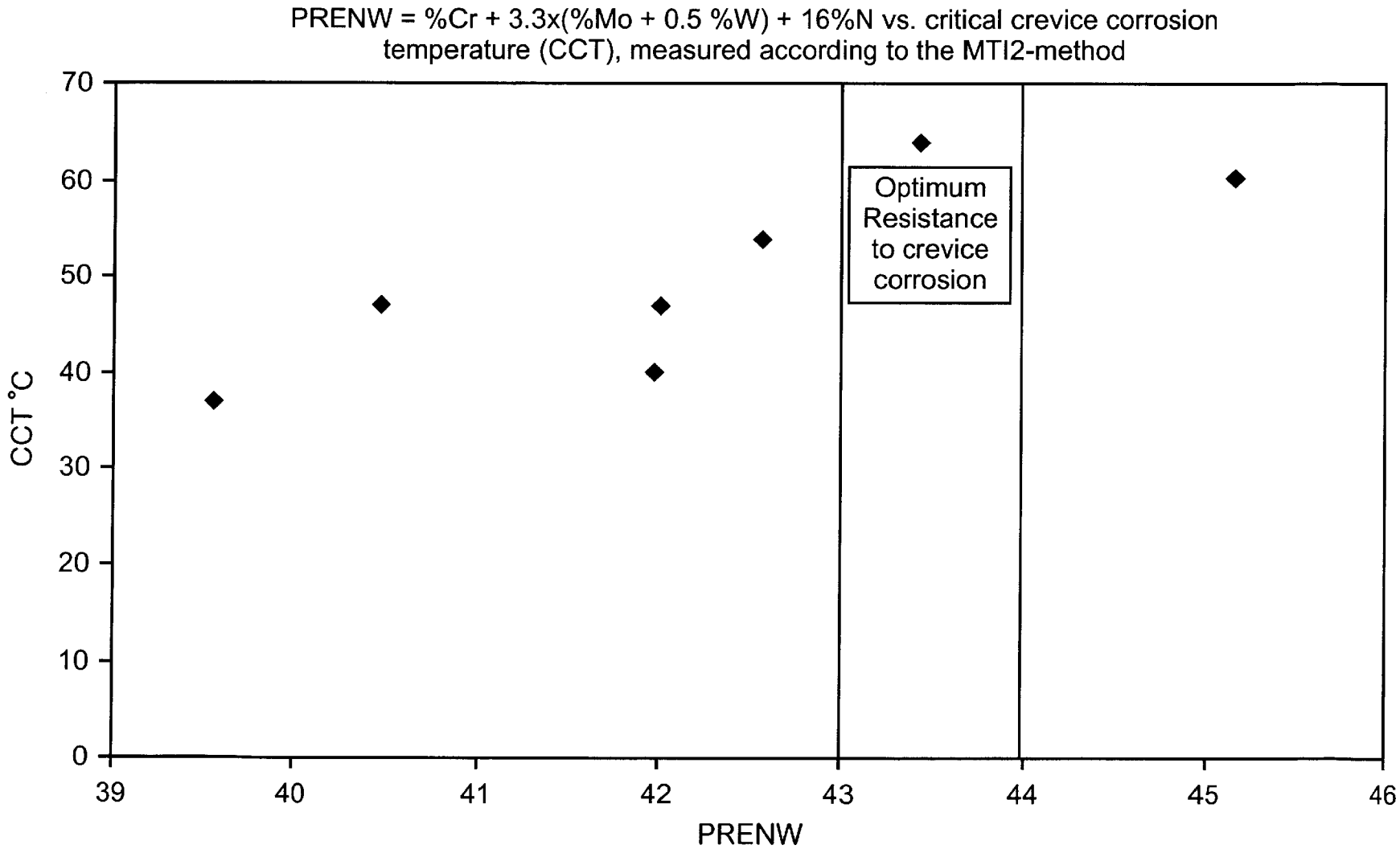
FIG. 5 is a plot of the PRENW value vs. the CCT value.

Very surprising it has shown that W at very high contents, in combination with low contents of Mo (heat 605084) results in very good pitting corrosion properties. Heat 605085 has a PRENW number which is higher than heat 605084, but in spite of this heat 605084 has a considerably higher CPT value. The same is valid for heat 605089, which in spite of that the material has a lower PRENW value than heat 605085, has a higher CPT value. The resistance to pitting corrosion measured as CCT value shows for heat 605084 and heat 605085 unexpectedly high values. For instance the material of type 2507 with a PRE over 40 has a CCT value of approximately 40° C. however, the crevice corrosion properties in heat 605089 are inferior to for heat 605085. The differences between those heats are that 605089 has a higher W content, but at the same time a lower content of N. In order to obtain a good corrosion resistance with regard to both pitting corrosion and crevice corrosion it is advantageous to have partly a high W content and partly a high N content. It also seems to be clear that there is an optimum PRENW value, so that if one has higher or lower PRENW values inferior properties will be obtained. The relation will be illustrated graphically in FIGS. 4–5.

The mixture in the ferrite phase and the austenite phase was determined with help of microprobe analysis. The results appear from Table 6.

TABLE 6

Mixture in the ferrite and austenite phase for tested heats

| Heat | Austenite % Cr | Austenite % Mo | Austenite % W | Austenite % N | Ferrite % Cr | Ferrite % Mo | Ferrite % W | Ferrite % N | Austenite PRENW | Ferrite PRENW |
|---|---|---|---|---|---|---|---|---|---|---|
| 654796 | 29.04 | 0.81 | 0.82 | 0.64 | 32.24 | 1.24 | 1.28 | 0.10 | 43.3 | 40.0 |
| 605084 | 27.55 | 0.75 | 2.99 | 0.62 | 29.55 | 1.22 | 4.91 | 0.10 | 44.9 | 43.3 |
| 605085 | 26.82 | 2.28 | 0.78 | 0.60 | 28.87 | 3.52 | 1.28 | 0.11 | 45.2 | 44.4 |
| 654793 | 28.02 | 0.83 | 0.83 | 0.49 | 32.75 | 1.27 | 1.44 | 0.10 | 40.0 | 40.9 |
| 605088 | 27.63 | 0.77 | 0.75 | 0.46 | 32.72 | 1.21 | 1.20 | 0.11 | 38.8 | 40.5 |
| 605089 | 26.54 | 0.77 | 2.83 | 0.47 | 30.24 | 1.24 | 4.65 | 0.11 | 41.3 | 43.8 |
| 605092 | 27.34 | 1.8 | 0.03 | 0.55 | 30.6 | 3.01 | 0.05 | 0.09 | 42.1 | 42.0 |

It appears that PRENW in the austenite phase and also in the ferrite phase in all cases except for heat 605088 are above 40. An unacceptable low CCT value for heat 605088 was obtained, which is probably due to the fact that the PRENW for the austenite phase is relatively low. For heat 605084 and 605085 PRENW is highest. The PRENW in both the austenite phase and the ferrite phase for heat 605085 is higher than for 605084, thus heat 605085 has a lower CPT according to ASTM G48C testing compared with 605084. The higher content of W in combination with a high content of N in heat 605084 can explain this effect. The reason why heat 605085 has an inferior structural stability to 605084 is probably due to the higher content of Mo in heat 605085, which increases the risk that the material contains precipitations and which reduce the resistance to pitting corrosion. An optimum PRENW value is in the range of 41–44. For an optimum corrosion resistance PRENW should be in the range of 43–44.

The resistance to intergranular corrosion was measured by the Streicher-test according to ASTM A262 Practice B. This test indicates how the material manages oxidizing acid environments and also the resistance of the material to intergranular corrosion. The results appear in Table 7.

TABLE 7

Results of corrosion testing according to ASTM A262 Practice B. The results are average values of two tests for every heat.

| Heat | Corrosion rate mm/year |
|---|---|
| 654796 | 0.16 |
| 605084 | 0.15 |
| 605085 | 0.24 |
| 654793 | 0.16 |
| 605088 | 0.14 |
| 605089 | 0.14 |
| 605092 | 0.17 |

It appears that the materials have very low corrosion rates in these tests. The differences are relatively little, but a material with simultaneously high Mo-content and high Cu-content shows the highest corrosion rate (heat 605085). If the Cu-content is high, but the Mo content low, a low corrosion rate is obtained (heat 605793, 605088, 605089). The combination of high contents of the elements Cr, Mo, W and N is beneficial for a good resistance to pitting corrosion. In addition to high Cu-contents it is consequently optimal to primarily use Cr, W and N to increase the resistance to pitting corrosion if one wants to have a good resistance to intergranular corrosion at the same time. Consequently heat 605089, with 2.0% Cu, 0.98% Mo and 3.8% W has very low corrosion rates at Streicher-testing.

The resistance to caustic liquor environments was tested by cooking in 60% NaOH (160° C.) for some heats.

The testing period was 1 and 3 days. The results appear from Table 8.

TABLE 8

Results of corrosion testing in cooking 60% NaOH (160° C.). Average values of double tests.

| Heat | Period 1 (24 h) mm/year | Period 2 (72 h) mm/year | Average (mm/year) |
|---|---|---|---|
| 605088 | 0.42 | 0.115 | 0.27 |
| 654793 | 0.30 | 0.075 | 0.19 |
| 654796 | 0.06 | 0.035 | 0.05 |
| 605089 | 0.61 | 0.175 | 0.39 |

Figure 6:
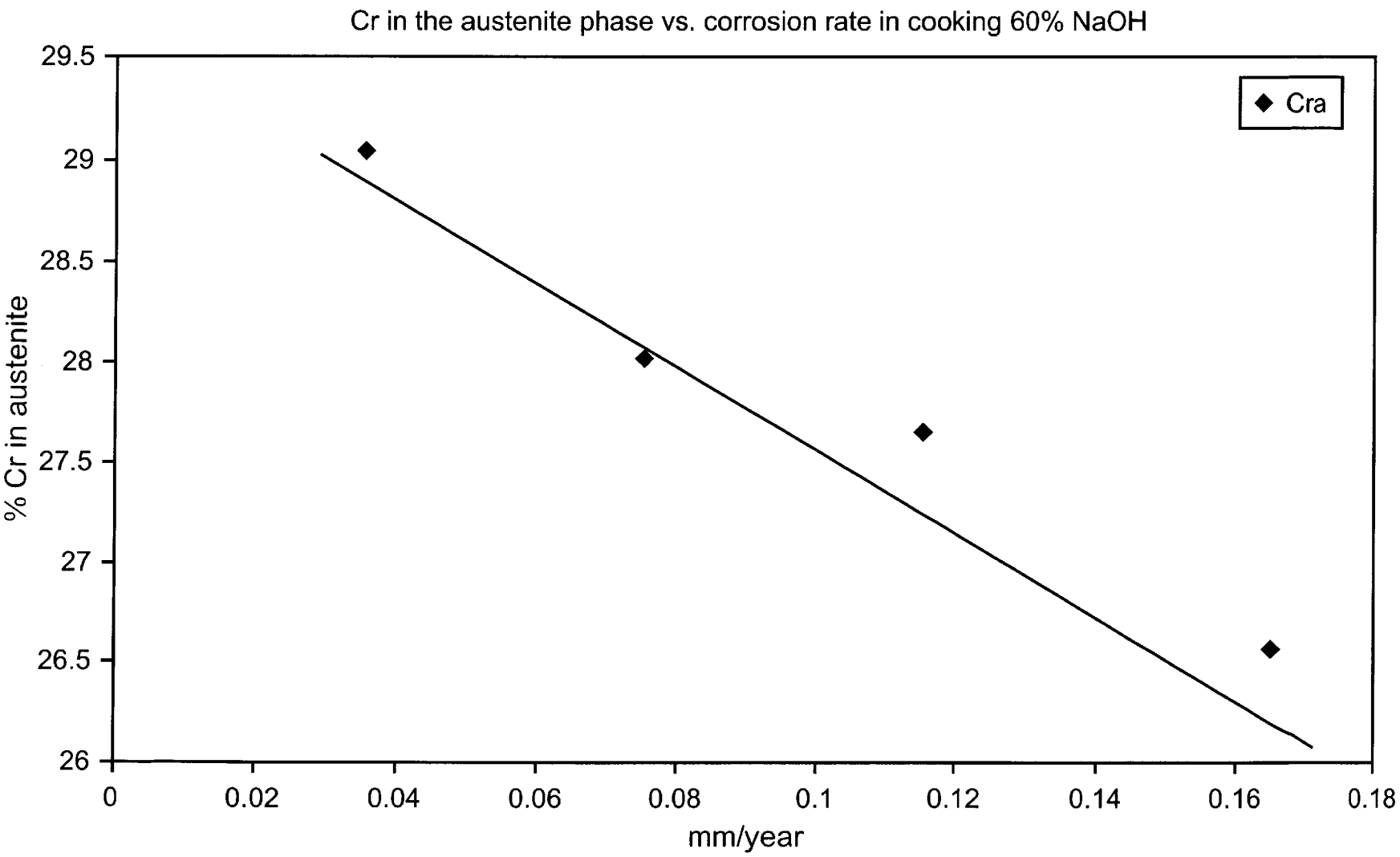
FIG. 6 is a plot of corrosion rate (mm/year) vs. Cr content in the austenite phase.

There is a relationship between the good corrosion properties in NaOH and the content of Cr in the austenite phase, so that the material with high contents of Cr in the austenite phase exhibits low corrosion rates upon exposure in NaOH. This relation is illustrated in FIG. 6.

Optimum Composition of Alloy According to the Invention

It has surprisingly shown that very good properties in a duplex steel with a chromium content exceeding 27% will be obtained if high Cu and W contents are also added to the material, as well as a high N-content. Accordingly, it has surprisingly shown that addition of high contents of W provides good impact strength at low temperatures. A high content of W in combination with a high content of N furthermore provides an outstanding resistance to crevice corrosion in chloride environments. The effect of W on the pitting and crevice corrosion properties is also surprisingly great. In order to obtain an adequate effect, an addition of at least 2% W is beneficial. Simultaneously, high contents of the elements Mo and W should be avoided. However, up to 4% W can be added if Mo is limited to below 2%, preferably below 1%. In order to obtain good corrosion and impact strength properties, and at the same time avoid precipitation of intermetallic phase, the %Mo+0.5% W value should be less than 3.52, preferably it should be less than 3. The addition of the element Cu has also surprisingly shown to slow down the precipitation of intermetallic phase upon slow cooling. This also implies that necessary hot working such as forging can be performed easier without risk of cracking caused by high contents of an intermetallic phase in the material. In order to obtain this effect, an addition of at least 0.5% Cu is beneficial, preferably at least 1.5%. If %Mo+0.5% W> it is requested that %Cu>1.5 in order to obtain the best hot workability in the material. In order to obtain good corrosion properties the relation %Cr+3.3 (%Mo+0.5% W)+16% N should exceed 40 in the weakest phase. For simultaneous good pitting and crevice corrosion resistance, W should exceed 2% and N should exceed 0.30%. An optimum resistance to pitting corrosion will be obtained if the PRENW number is in the range of 41–44. Furthermore, for optimum resistance to crevice corrosion PRENW should preferably be in the range of 43–44. With the purpose of also obtaining good structural stability, copper should be added to the material. However, copper can cause an unfavorable effect on the intergranular corrosion when combined with a high content of Mo. In order to optimize the material with regard to the intergranular corrosion, a high content of Cu should therefore be combined with a low content of Mo. In order to ensure good pitting corrosion properties one should add high contents of W. In order to obtain good resistance in basic environments the Cr-content in the austenite phase should be at least 28%.

While the present invention has been described by reference to the above-described embodiments, certain modifications and variations will be evident to those of ordinary skill in the art. Therefore the present invention is to limited only by the scope and spirit of the appended claims.

I claim:

1. A ferrite-austenite steel alloy having good warm workability, high resistance to crevice corrosion and good structural stability, comprising in weight %:

C maximum 0.05%;

Si maximum 0.8%;

Mn 0.30–4.0%;

Cr 27.0–35.0%;

Ni 3.0–10.0%;

Mo 0–2.0%;

N 0.30–0.40%;

Cu 0.5–3.0%

W 3.0–4.0%;

S maximum 0.010%; and balance Fe and normally occurring steel making additions for deoxidization and hot ductility;

wherein %Mo+0.5% W is less than 3.52 and %Cr+3.3 (%Mo+0.5% W) +16N is 41–44 and the alloy comprises 30–70 volume % ferrite and the balance austenite.

2. The alloy according to claim 1, wherein the content of ferrite is between 35–55%.

3. The alloy according to claim 1, wherein the content of Mo is 0–1.0%.

4. The alloy according to claim 1, wherein %Mo+0.5% W is less than 3.

5. The alloy according to claim 1, wherein the content of Cu is 1.5–3.0%.

6. The alloy according to claim 1, wherein %Mo+0.5% W is less than 3.52 and the content of Cu does not exceeds 1.5%.

7. The alloy according to claim 1, wherein %Cr+3.3 (%Mo+0.5% W)+16N exceeds 40 both in the ferrite and the austenite phases.

8. The alloy according to claim 1, wherein the content of Cr in the austenite phase is at least 28%.

9. The alloy according to claim 1, wherein %Cr+3.3 (%Mo+0.5% W)+16N is 43–44.

10. The alloy according to claim 8, wherein the content of Cr in the austenite phase is at least 29%.

11. A ferrite-austenite steel alloy having good warm workability, high resistance to crevice corrosion and good structural stability, comprising in weight-%:

C maximum 0.05%;

Si maximum 0.8%;

Mn 0.30–4.0%;

Cr at least 28%–35.0%;

Ni 3.0–10.0%;

Mo 0–2.0%;

N 0.30–0.55%;

Cu 1.5–3.0%;

W 2.0–5.0%;

S maximum 0.010%; and balance Fe and normally occurring steelmaking additions for deoxidization and hot ductility;

wherein the alloy comprises 30–70 volume % ferrite and the balance austenite.

12. The alloy according to claim 11, wherein the content of Cr is at least 29%.

13. A ferrite-austenite steel alloy having good warm workability, high resistance to crevice corrosion and good structural stability, comprising in weight-%:

C maximum 0.05%;

Si maximum 0.8%;

Mn 0.30–4.0%;

Cr at least 28%–35.0%;

Ni 3.0–10.0%;

Mo 0–2.0%;

N 0.30–0.55%;

Cut 0.5–3.0%;

W 3.0–4.0%;

S maximum 0.010%; and balance Fe and normally occurring steelmaking additions for deoxidization and hot ductility;

wherein the alloy comprises 30–70 volume % ferrite and the balance austenite.

14. The alloy according to claim 13, wherein the content of Cr is at least 29%.

* * * * *